United States Patent [19]

Kozminski

[11] 4,302,859

[45] Dec. 1, 1981

[54] SURFBOARD AND METHOD OF CONSTRUCTING SAME

[76] Inventor: Andre A. Kozminski, 3642 Euclid Ave., San Diego, Calif. 92105

[21] Appl. No.: 75,883

[22] Filed: Sep. 17, 1979

[51] Int. Cl.[3] ..... A63C 5/00

[52] U.S. Cl. ..... 9/310 E; 144/309 AB

[58] Field of Search ..... 9/310 R, 310 B, 310 E, 9/13, 6.5, 6 R, 6 P, 6 W; 144/309 AB, 315 R, 315 A, 316, 317; 114/292; 244/123, 124

[56] References Cited

U.S. PATENT DOCUMENTS 1,427,941 9/1922 Blenio ..... 244/123

1,830,015 11/1931 Carmichael ..... 9/310 E

*Primary Examiner*—Trygve M. Blix

*Assistant Examiner*—Jesus D. Sotelo

*Attorney, Agent, or Firm*—Roy Knox

[57] ABSTRACT

A new surfboard and method for making a surfboard out of wood so that it will be lighter and stronger than any heretofore produced. It is a method of construction using sheets or panels of wood, separators or spacer blocks between those sheets, which could be of light wood or plastic foam and finally rail or edge pieces also of light wood, balsa, that are subsequently glued to the aforementioned core of sheets and separators.

10 Claims, 20 Drawing Figures

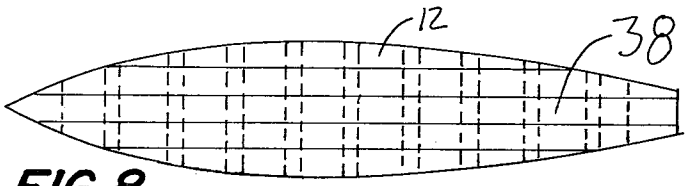
FIG. 8
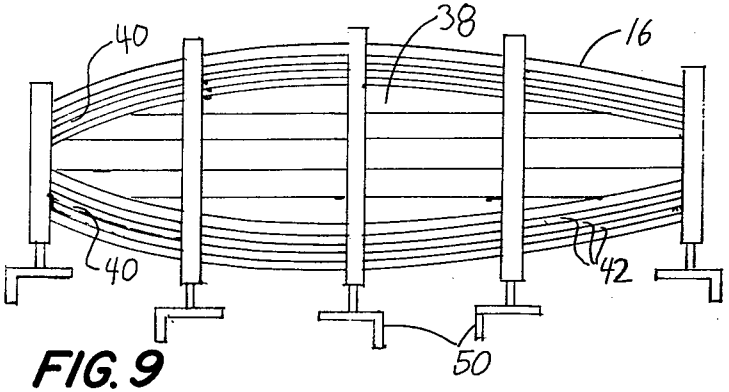
FIG. 9
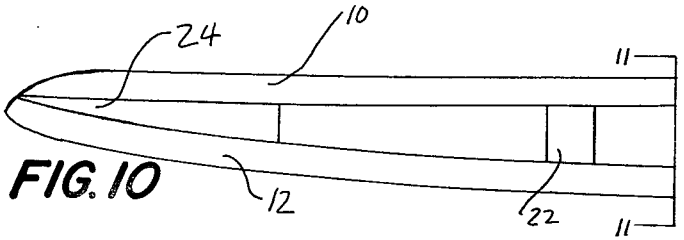
FIG. 10
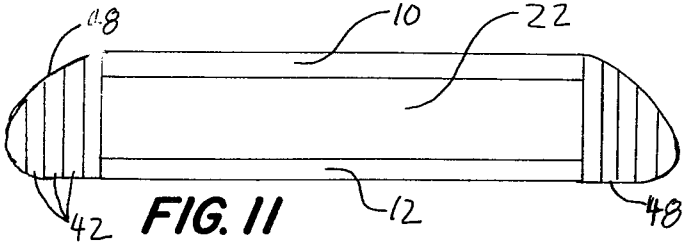
FIG. 11
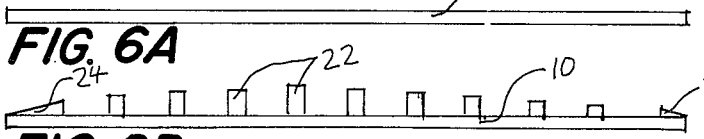
FIG. 6A
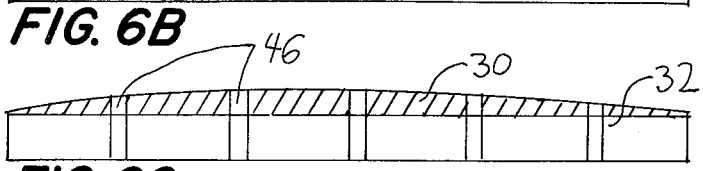
FIG. 6B
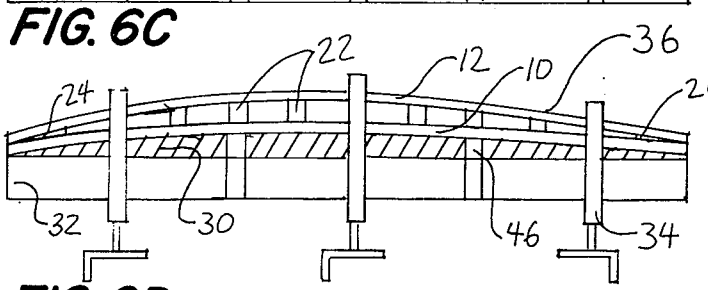
FIG. 6C
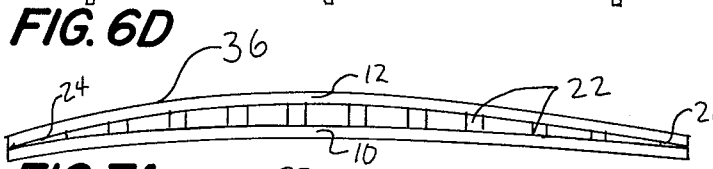
FIG. 6D
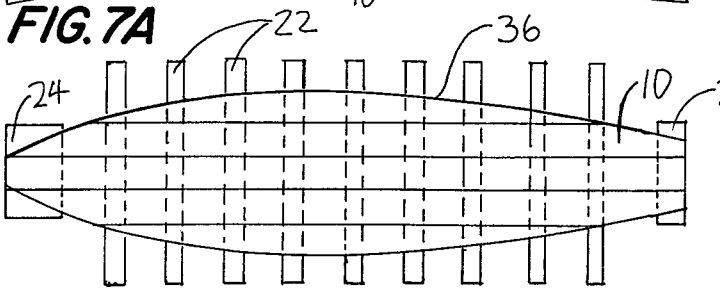
FIG. 7A
FIG. 7B

SURFBOARD AND METHOD OF CONSTRUCTING SAME

BACKGROUND OF THE INVENTION

The idea of building chambers into wooden surfboards is by no means original with the inventor as such craft have been built since at least 1925. Even a recent design that has been brought out using plywood sheets has come to the attention of the inventor. This recent design is conceptually no different than the age old "paddle board" design that consisted of two bi-dimensionally curved edged or rail pieces flexed and held in place at either end by solid blocks and also by spacers along their length. Then plywood skins were affixed to the top and bottom of this skeleton and the whole thing was then painted and launched. It should be noted that this apparatus never gained wide popularity as a surf riding vehicle because of its fragility, weight, and lack of versatility in refinements of shape; or more specifically the edges or rails must always be nearly square and very little curvature (as seen edgewise) can be built into it.

Now the benefits of this new system are that it is possible to use balsa instead of other heavier materials while retaining even more strength than the standard polyurethane core-fiberglass reinforced system so popular today. And this balsa construction is so light that it can be fibreglass reinforced just as the common solid polyurethane foam product and actually weigh less.

The third major advancement my system boasts is a complete freedom in the shape of the completed product. As surfboards are hand made and custom built, the precise wishes of the client are to be catered to. My system allows this.

SUMMARY OF THE DISCLOSURE

All this is made possible by two main innovations in the manufacture of the wooden construction. Once the edge view curvatures and thickness flow have been formulated, the two panels that are to be the top and bottom skins of the surfboard are flexed over a special adjustable jig and glued permanently into said curvatures with the aid of the aformentioned separators and also wedge blocks at the two ends, that is, at each tip where the panels meet. Once the glue is dry and this core now describes the curves, both upper and lower, of the surfboard it is now laterally trimmed to reflect the plan view of what the finished product is to be. Then five separate straight laminae of balsa are flexed and glued on to follow this curve. This gives solid balsa edges while maximizing the cavities in the core section. This idea of commencing with the sheets and making of the core by means of the special jig and supplementing with precut laminated rails allows greater freedom in curvature as it does not require trying to straighten out the precut curved rail laminae and allows the use of very rigid and strong but light balsa wood as opposed to plywood for the panels. Because of the rigidity of this system it is not necessary to provide an equalizer or breather hole to equalize the atmospheric pressure. The old plywood designs blew up in the hot sun unless so equipped, whereas this design tolerates sun as well as flights in the unpressurized cargo wells of aircraft.

BRIEF DESCRIPTION OF THE DRAWINGS

FIGS. 6A, 6B, 6C, 6D illustrate the arrangement of the core portions and the profile negative form block on a jig and the clamping to form the core into generally concavo-convex configuration.

FIGS. 7A, 7B show the semi-completed assembly in elevation and plan after being formed on the jig.

FIG. 8 illustrates the formed assembly after being trimmed.

FIG. 9 illustrates the step of clamping the laminae of the rails onto the trimmed assembly.

FIG. 10 is a fragmentary vertical sectional view of the completed surfboard.

FIG. 11 is a cross-sectional view taken on the line 11—11 in FIG. 10.

DETAILED DESCRIPTION OF A PREFERRED EMBODIMENT

Figure 3:
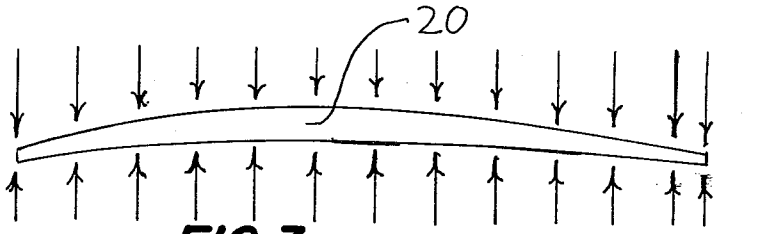
FIG. 3 shows an edge profile template used in constructing the surfboard, the arrows indicating the measurements taken of the vertical height or thickness of the surfboard at multiple stations.

Referring now to the drawings wherein like numerals refer to like or identical parts and portions throughout the different views, it will first be noted that FIGS. 1–9 illustrate the principal steps in the claimed method of constructing the surfboard and FIGS. 10 and 11, considered with the other figures, show principal novel features of the surfboard.

Figure 1A:
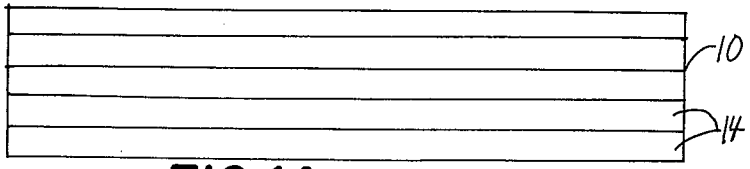
FIGS. 1A, 1B show a view of the two composite panels used as top and bottom skins and can be considered as illustrating the first part of the first step in construction of the surfboard.
Figure 1B:
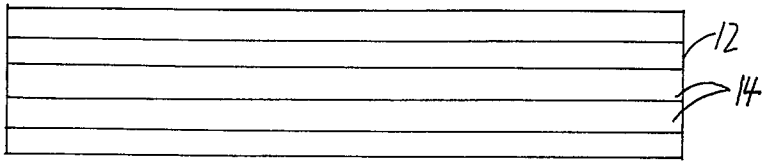
Figure 2A:
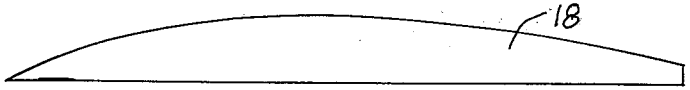
FIGS. 2A, 2B, 2C show a view of a plan template used in constructing the surboard and plan views of the panels rough cut to the template illustrating a second part of the first step.
Figure 2B:
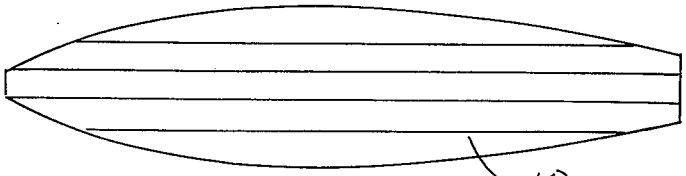
Figure 2C:
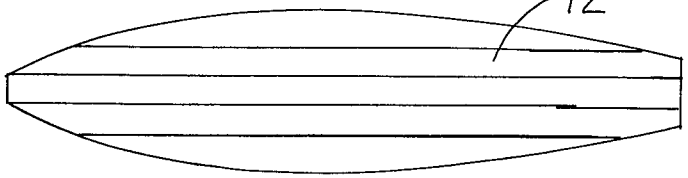

The hereindisclosed method and structure are adapted for use with light weight, strong, water-nonsoluble materials and the preferred material is balsa wood. The order of the steps in constructing the surfboard can obviously be altered to some degree but a reasonable progression begins with the fabrication of two composite panels 10 and 12 of balsa. These panels may be identical, each comprising a plurality of strips 14 bonded together as indicated in FIG. 1. The term glue will be used herein as including any suitable adhesive and the strips may be on the order of 7 feet long, approximately three inches wide and $\frac{5}{8}$ of one inch thick so that the resulting panels are at least as wide as the surfboard less the corresponding width of the two laminated rails 16 hereinafter described. These panels 10 and 12 are rough cut to this width and generally double convex plan shape as indicated in FIG. 2 using a template such as the half plan template 18.

Figure 4A:
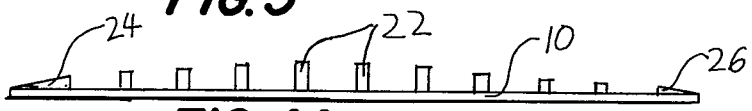
FIGS. 4A, 4B show, in elevation and in plan, the steps of gluing spacer blocks on one of said panels.
Figure 4B:
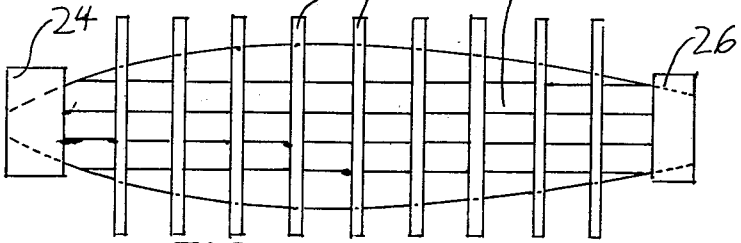
Figure 5A:
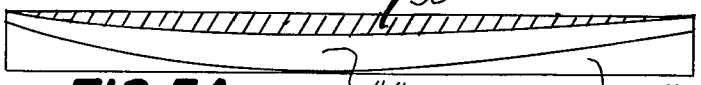
FIGS. 5A, 5B illustrate the formation of a profile negative form block (claim 4).
Figure 5B:
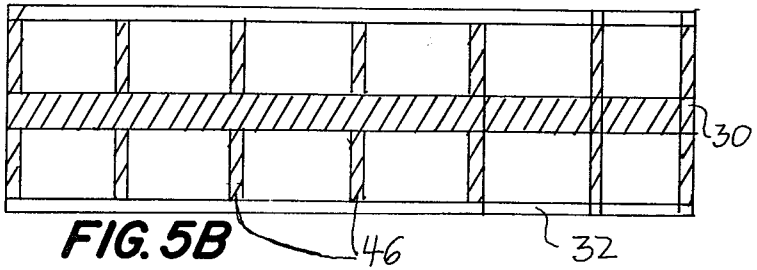

The next step, or series of sub-steps, is concerned with forming the surfboard with the desired generally concavo-convex side profile. A vertical side edge profile template 20, ordinarily of plywood or the like, is made and a plurality of measurements, on the order of 14, are taken as indicated in FIG. 3 to reflect the varying thickness. These measurements are each reduced by the sum of the thicknesses of the panels 10 and 12 to give the height dimensions for spacer blocks 22. These spacer blocks may be on the order of 1.5 inches wide pieces of balsa and are glued in spaced relation onto one side of one of the panels, indicated as panel 10, transversely as shown in FIG. 4, along with fore and aft terminal wedges 24, 26 used conventionally in surfboard construction. The side edge template 20 can be used as a guide for a tracing on the edge of a slab 28 so that a form 30 can be cut out of the slab to represent the negative or reverse of the generally concave side of the surfboard. This form 30 can be placed, flat side down, on a jig 32 and, as illustrated in FIG. 6, the panel 10 placed thereon with the spacer blocks 22 uppermost and with the panel 12 superimposed above the panel 10 this assembly 36 can be supplied with glue on the interfaces of the spacer blocks 22 and panel 12, and the assembly 36 clamped onto the form 30 by jig clamps 34 to achieve the desired generally concavo-convex configuration of a surfboard. It will of course be obvious that this configuration may vary and that many desired configurations reflect a comparatively extensive middle portion which is generally flat longitudinally of the surfboard or even slightly reverse curved. It may be noted that the form 30, if cut from a slab of balsa may have a width much less than the width of the assembly 36 and in this case a plurality of side blocks 46 are used to flank the form 30 as indicated in FIG. 6.

When the glue dries and sets the assembly 36 is "popped" from the jig 32 and retains the formed configuration illustrated in FIG. 7. The assembly 36 is now fine trimmed as indicated in FIG. 8 at 38 and is ready to receive the rails 40—40.

The rails 40 are each laminated, the vertical laminae 42 being preferably strips of balsa having a thickness on the order of one centimeter to permit the bending thereof around the curved side edges of the assembly which has been fine trimmed as at 38, and the width of the laminae in pre-cut form must be at least equal to the vertical height dimension of the edge of the assembly 30 at all points, so that the ends of the spacer blocks 22 and the gaps therebetween will be closed by the rails. A very important feature of this invention is the pre-cutting of the laminae 42 with a vertical or breadth curvature conforming to the curved side edge configuration of the assembly 36 as seen in the elevation view in FIG. 7. This is accomplished by rip-cutting slab portions shaped as at 44 in FIG. 5. In fact, a slab portion 44 cut from the slab 28 can be rip-cut into laminae 42 to provide some of the laminae required for the rails 40. Since the laminae need be bent only in one sense, the horizontal direction, to fit onto the assembly 36 the strength and structural integrity of the surfboard is enhanced even though a limited flexibility is retained. As indicated in FIG. 9 the laminae 42 are glued to each other, to the curved edges of the panels 10 and 12 and to the ends of the spacer blocks 22. Clamping means such as the spanner clamps 50 hold the rails in position while the glue dries and sets.

Various forms of wedges 24–26 and wear-resistant tips and accessories such as fin boxes and fins are conceived as compatible with the method and structure of a surfboard described above and conventional procedures for smoothing and finishing, as well as coating the surfboard with fiberglass, polyester resin and the like, are all conceived as being somewhat uncritically related to the claimed method and structure.

In any case the finishing of the surfboard will include the radiusing of the rails 40 to some configuration such as that indicated at 48 in FIG. 11 and the fore and aft ends are also radiused. From the foregoing it will be clear that a very light weight, yet strong structure for a surfboard is disclosed, great versatility of design is provided for, and the method of fabrication is simple, expeditious and economical.

What I claim as new and desire to secure by Letters Patent is:

1. A method of constructing a surfboard comprising the following steps in substantially the order named:

(a) providing two panels, of slightly less width and substantially the same length and plan configuration as the desired surfboard, to be used as the top and bottom skins;

(b) inserting a set of separate and discrete spacer blocks of light weight strong material between said top and bottom skins, said blocks being of critical and varied height dimensions and critically located so that the assembly duplicates the thickness dimensions of the desired surfboard, applying glue to the interfaces of the blocks and skins, and forming the assembly in a jig while the glue sets to achieve the desired longitudinal, generally concavo-convex edge profile of the surfboard;

(c) building rails onto the vertical side edges of said assembly in the form of vertical laminae pre-cut with the same generally concavo-convex profile and of light weight, strong, water-insoluble material, the laminae on each side being glued together and glued to said vertical side edges; and (d) smoothing, finishing and coating the surfboard.

2. A method according to claim 1 wherein the step (a) includes fabricating each panel by gluing together strips of balsa, each strip being on the order of $7' \times 3'' \times \frac{5}{8}''$ of form a composite panel capable of being formed, in a jig, to said generally concavo-convex profile as recited in claim 1 (b).

3. A method according to claim 1 wherein the step (b) includes:

(i) making said spacer blocks to the precise height dimensions corresponding with the edgewise thickness measurements, at spaced stations along the desired surfboard, less the thicknesses of the skins;

(ii) said glue being first applied in two stages, first to the interface of the blocks, and one of said skins to simplify the placement of the blocks, and then to the second skin which is lowered onto the tops of blocks as the jig forms the assembly into said concavo-convex profile.

4. A method according to claim 3 wherein said forming the assembly in step (b) also includes:

(i) using a template defining the longitudinal edge profile of the desired surfboard to trace that edge profile on the edge of a flat slab of light weight, strong, water-insoluble material and then cutting the slab along the tracing to produce a form block with a profile negative of the generally concavo-convex edge profile of the surfboard; and (ii) using this profile form block on the jig to produce the generally concave configuration on that side of said assembly adjacent to the jig.

5. A method according to claim 4 wherein that concavo-convex portion of said slab remaining after cutting out said form block is rip cut vertically and longitudinally to provide at least some of the laminae of claim 1 (c) whereby said laminae are initially configured to conform, in the vertical sense, precisely with the generally concavo-convex vertical side edges of the assembly.

6. A method according to claim 1 wherein said step (c) building rails includes clamping said laminae onto the vertical side edges while the glue is drying and setting, and then radiusing the rails.

7. A surfboard comprising:

(a) two similar panels of light weight, strong water-nonsoluble material, extending substantially the full length of the surfboard and spaced apart to comprise an upper and a lower skin;

(b) spacer blocks, separate and discrete from each other and secured to and between said panels, said blocks being of graduated varying height dimensions, and the thus assembled panels defining a generally concavo-convex assembly with both forward and tail ends tapered both horizontally and vertically; and (c) side rails on the side edges of said assembly, each side rail comprising a plurality of vertical laminae secured to the panels and the ends of said spacer blocks and closing the spaces therebetween.

8. A surfboard according to claim 7 wherein each of said panels comprises a plurality of elongated strips of balsa glued together edge to edge to constitute a composite panel.

9. A surfboard according to claim 8 wherein said elongated strips and said composite panel have a thickness dimension on the order of $\frac{5}{8}$ of one inch, and said spacer blocks extend transversely of said concavo-convex assembly (claim 7 (b)) and are of varying length to correspond with the width of the concavo-convex assembly and widely spaced apart to achieve a slight flexibility of the surfboard.

10. A surfboard according to claim 7 wherein said laminae are on the order of 1 cm. in thickness to permit bending thereof in a horizontal direction to fit the horizontally tapered assembly (claim 7 (b)) and said laminae being pre-cut to fit the edges of said concavo-convex assembly without bending in a vertical direction during the fabrication of the surfboard, thus improving structural integrity.

* * * * *